US006438867B1

(12) United States Patent
Teich et al.

(10) Patent No.: US 6,438,867 B1
(45) Date of Patent: Aug. 27, 2002

(54) METHOD FOR DRYING AND PRODUCING MICROPOROUS PARTICLES AND A DRYING DEVICE

(75) Inventors: Friedhelm Teich, Edingen-Neckarhausen; Heiner Schelling, Kirchheim; Herbert Köster, Ludwigshafen; Horst Kratzer, Frankenthal; Wolfgang Reichert, Frankenthal; Martin Gall, Mutterstadt; Bernd Ziegler, Kornwestheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/623,873

(22) PCT Filed: Mar. 11, 1999

(86) PCT No.: PCT/EP99/01591

§ 371 (c)(1),
(2), (4) Date: Sep. 11, 2000

(87) PCT Pub. No.: WO99/46203

PCT Pub. Date: Sep. 16, 1999

(30) Foreign Application Priority Data

Mar. 11, 1998 (DE) ..... 198 10 564

(51) Int. Cl.[7] ..... F26B 3/00

(52) U.S. Cl. ..... 34/470; 34/329; 34/340; 34/351; 34/338; 34/349; 34/389; 264/42; 264/49; 264/50; 252/62; 423/338

(58) Field of Search ..... 34/329, 340, 351, 34/338, 349, 470, 389; 264/42, 49, 50; 502/232; 252/62; 423/338

(56) References Cited

U.S. PATENT DOCUMENTS 2,249,767 A * 7/1941 Kistler ..... 34/9
4,610,863 A * 9/1986 Tewari et al. ..... 423/338
4,667,417 A * 5/1987 Graser et al. ..... 34/9

(List continued on next page.)

FOREIGN PATENT DOCUMENTS

WO WO-9609117 * 3/1996
WO WO-9620822 * 7/1996

OTHER PUBLICATIONS

Tajiri et al., "Effects of Supercritical Drying Media on Structure and Properties of Silica Aerogel", 1995, Journal of Non–Crystalline Solids, vol. 186, pp. 83–87.*

(List continued on next page.)

*Primary Examiner*—William Doerrler
*Assistant Examiner*—Mark Shulman
(74) *Attorney, Agent, or Firm*—Oblon, Spivak, McClelland, Maier & Neustadt, P.C.

(57) ABSTRACT

In a process for drying microporous, fluid-containing particles, the heat required for increasing the temperature is supplied by convection by reducing the interfacial tension of the fluid, preferably to 0 to 1/10, in particular to 0 to 1/20, of the interfacial tension of the fluid at room temperature, by appropriately increasing the temperature at from close to the critical pressure to supercritical pressure of the fluid. Furthermore, microporous, three-dimensionally networked particles are prepared by a process in which the drying process is used. In addition, an apparatus is used for carrying out the drying process, the apparatus comprising a pressure container having an inner container and pressure-withstanding outer container and suitable measuring and control apparatuses and pump apparatuses and heat exchangers, the inner container being provided for holding the particles to be dried and a gap being provided between the inner container and the outer container.

12 Claims, 1 Drawing Sheet

U.S. PATENT DOCUMENTS

| | | | | | |
|---|---|---|---|---|---|
| 5,680,713 | A | * | 10/1997 | Forbert et al. | 34/342 |
| 5,705,535 | A | * | 1/1998 | Jansen et al. | 521/64 |
| 5,738,801 | A | * | 4/1998 | Zeigler et al. | 252/62 |
| 5,935,895 | A | * | 8/1999 | Baiker et al. | 502/349 |
| 6,017,505 | A | * | 1/2000 | Zeigler et al. | 423/338 |

OTHER PUBLICATIONS

Van Bommel et al., "Drying of Silica Gels with Supercritical Carbon Dioxide", 1994, Journal of Material Science, vol. 29, pp. 943–948.*

* cited by examiner

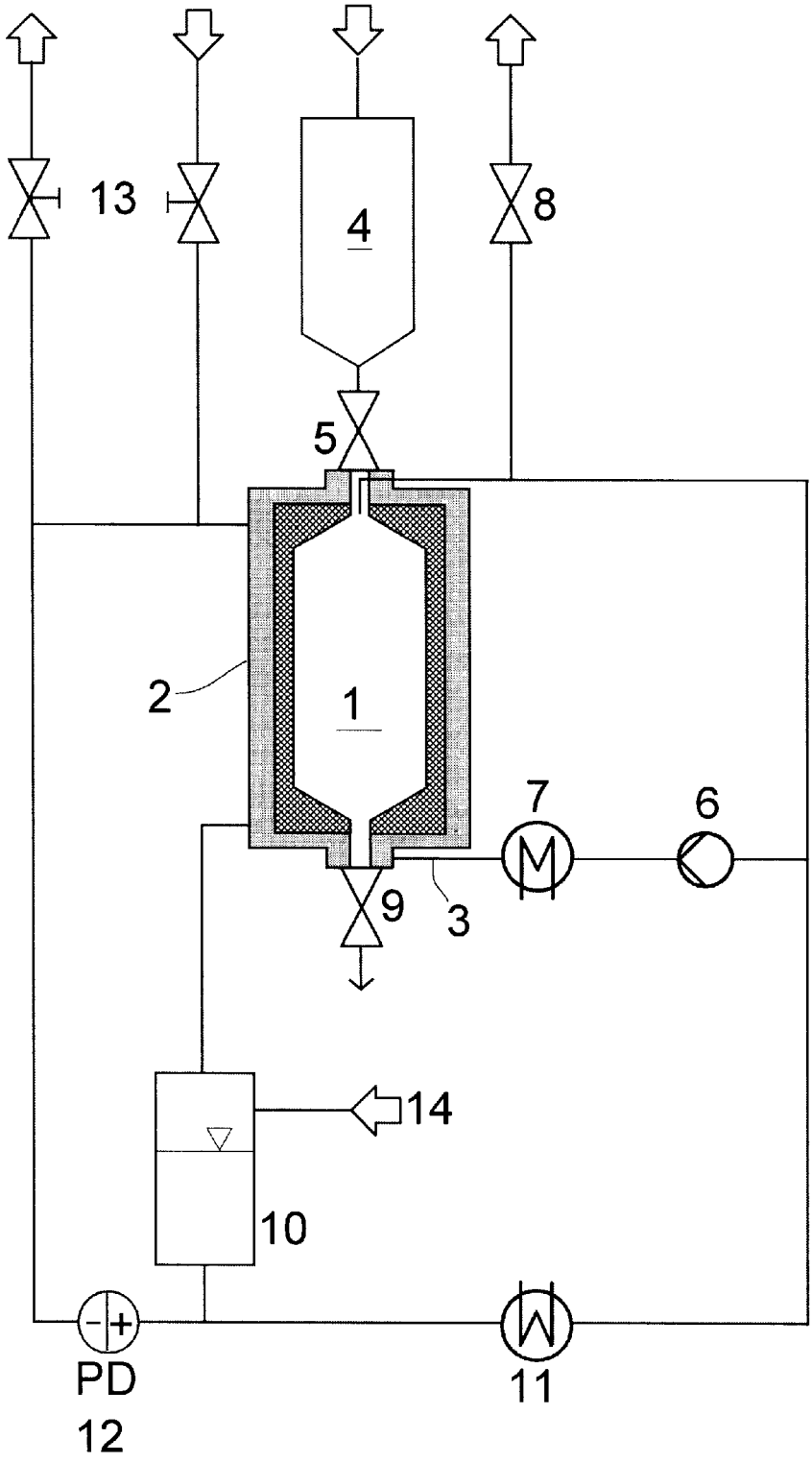
13
4
8
5
2
1
7
6
9
3
14
10
PD
12
11

METHOD FOR DRYING AND PRODUCING MICROPOROUS PARTICLES AND A DRYING DEVICE

The present invention relates to a process for drying microporous, fluid-containing particles, a process for the preparation of microporous, three-dimensionally networked particles in which this drying process is used, and an apparatus for carrying out the drying process.

It is known that hydrogels, e.g. silica hydrogels, which can be prepared by precipitating a gel from waterglass, can be dried under supercritical conditions to give microporous, three-dimensionally networked silica particles. During this supercritical drying, the interfacial tension of the fluid contained in the microporous, three-dimensionally networked particles is completely or substantially eliminated, with the object of substantially avoiding shrinkage of the microporous, three-dimensionally crosslinked particles during the drying, since characteristic properties of the microporous, three-dimensionally crosslinked particles are completely or partly lost in the case of shrinkage. In the case of gels, such a product obtained by supercritical drying is referred to as an aerogel. In contrast to the conventional drying without particular measures, during which the gels suffer a large volume contraction and xerogels form, only a small (<15%) volume contraction thus occurs on drying close to the critical point.

The prior art for the preparation of aerogels by means of supercritical drying is described in detail, for example, in Reviews in Chemical Engineering, Volume 5, No. 1–4, pages 157–198 (1988), in which the pioneering work of Kistler is also described.

In the known processes for the preparation of an aerogel, the required heat for circumventing the two-phase region of the fluid contained in the pores of the particles to be dried is supplied by conduction through the container wall (cf. Reviews in Chemical Engineering, Volume 5, No. 1 to 4 (1988); Ind. Eng. Chem. Res. 30 (1991), 126–129; and Journal of Materials Science 29 (1994), 943–948). It is known that the wall/volume ratio becomes more unfavorable with increasing container volume, correspondingly increasing the batch times on scale-up. Furthermore, the thickness of the pressure-resistant container wall increases with the container diameter. In the case of heat supply externally into a thick-walled container under pressure, thermal stresses in the container wall limit the temperature difference between the inner surface and outer surface of the pressure-resistant container, so that the specific heat supplied by unit volume (watt/$m^3$) into the pressure-resistant container is additionally reduced.

WO-A-95 06 617 relates to hydrophobic silica aerogels, which are obtained by reacting a waterglass solution with an acid at a pH of from 7.5 to 11, substantially removing ionic components from the resulting hydrogel by washing with water or dilute aqueous solutions of inorganic bases while keeping the pH of the hydrogel at from 7.5 to 11, displacing the aqueous phase contained in the hydrogel by an alcohol and then subjecting the alcogel obtained to supercritical drying.

A process for the preparation of a silica aerogel on the pilot scale is described by White in Industrial and Engineering Chemistry, Volume 31 (1939), No. 7, pages 827–831, and in Trans. A. J. Chem. E. (1942), 435–447. The process comprises the following steps: preparation and aging of a silica hydrogel, comminution of the hydrogel to give granules, separation of the salt from the gel formed, replacement of the water in the gel by alcohol, introduction of the gel, dried so that it no longer drips, into a pressure-resistant container, heating of the pressure-resistant container, reduction of the pressure to atmospheric pressure, evacuation of the pressure-resistant container and subsequent removal of the aerogel. The disadvantage of this process is that all steps are carried out batchwise and are thus very time-consuming, labor-intensive and expensive. White does not mention any continuous processes for the preparation of granules or for the removal of salt. In the water/alcohol exchange, White prefers, for the liquid phase, a procedure to be described as "covering with a layer/impregnation/drainage", which procedure constitutes intermittent treatment of the solids bed with liquid. White believes that flow-through uniformly as a function of time is less economical.

According to U.S. Pat. No. 3,672,833, the known processes for the removal of salt from gels and for the replacement of water by other solvents are extremely tedious and hence expensive processes. To circumvent this, this U.S. patent proposes preparing the gel from lower alkyl orthosilicates. However, these require considerable energy in their preparation.

It is an object of the present invention to provide an improved, more economical process for drying microporous, fluid-containing particles, an apparatus suitable for carrying out this process and an improved, more economical process for preparing microporous, three-dimensionally networked particles with the use of the drying process, the abovementioned disadvantages of the prior art being avoided.

We have found, surprisingly, that this object is achieved if the heat required for heating to temperatures which are at least close to the critical temperature of the fluid is supplied by convection. We have furthermore found that this measure can be carried out particularly advantageously in an apparatus in which a pressure container has an inner container and a pressure-withstanding outer container, a gap being provided between the inner and the outer container, and the apparatus has suitable measuring and control apparatuses and pumps and heat exchangers. We have furthermore found that microporous, three-dimensionally networked particles can be prepared in a particularly advantageous manner if, in addition to the use of the abovementioned drying process, any required washing and/or removal of salt or a fluid exchange in the pores of the microporous particles and any required removal of sorbed gases or substances are carried out in each case in a moving bed by the countercurrent method.

The present invention therefore relates to a process for drying microporous, fluid-containing particles by reducing the interfacial tension of the fluid, preferably to 0 to 1/10, in particular to 0 to 1/20, of the interfacial tension of the fluid at room temperature, by appropriately increasing the temperature at from close to the critical pressure to supercritical pressure of the fluid. The novel process comprises supplying the heat required for the temperature increase by convection.

The present invention also relates to an apparatus for carrying out this drying process, which comprises a pressure container having an inner container and a pressure-withstanding outer container and suitable measuring and control apparatuses and pump apparatuses and heat exchangers, the inner container being provided for holding the particles to be dried and a gap or space being provided between the inner container and outer container.

The region in which the procedure is preferably carried out according to the invention can be defined by the fact that the microporous particles do not lose their properties during the drying; this means that, for example, the apparent density of the product does not increase significantly, that the thermal conductivity of the product does not increase significantly, and that preferably no shrinkage above 15%, in particular above 10%, occurs. This situation can also be described by the fact that the aerogel may not become a xerogel (gel dried at atmospheric pressure).

The abovementioned interfacial tension is determined as described in The Properties of Gases and Liquids by Reid, Brausnitz and Sherwood, McGraw Hill, 1977, page 601 et seq., the interfacial tension at the temperature (and pressure) to be tested and that at room temperature and atmospheric pressure being measured under otherwise identical conditions and compared.

In a further embodiment, the invention relates to a process for the preparation of microporous, three-dimensionally networked particles by (a) preparing microporous particles containing pore liquid or fluid, (b) if required, washing and/or removing salt from the particles obtained in stage (a) and containing pore liquid, by means of a solvent and/or water, (c) if required, partially or completely exchanging the pore liquid or the solvent or the water in the particles for a fluid to obtain microporous, fluid-containing particles, (d) drying the microporous, fluid-containing particles and (e) if required, separating off sorbed gases and/or substances from the dried particles from stage (d).

In the novel process, the drying is carried out as described above and stages (b), (c) and (e), if they are carried out, are effected in a moving bed by the countercurrent method by passing the particles obtained in stage (a) countercurrent to a solvent stream and/or water stream in stage (b), passing the particles countercurrent to the fluid in stage (c) and passing the dried particles countercurrent to an inert gas stream in stage (e). Preferred embodiments of the invention are described in the following description, the subclaims, the Figure and the Example.

The only Figure of the attached drawing schematically shows an apparatus which is suitable for carrying out the novel drying process.

The microporous, fluid-containing particles which are suitable for the novel drying are not subject to any particular restrictions per se. All particles, solids, structures or granules which are at least partly, preferably wholly, microporous and contain a fluid in the pores are suitable. Suitable particles are, for example, gels which consist of inorganic or organic materials or of polymer material, for example of inorganic oxides or hydroxides, such as boric or silicic acid, oxides or hydroxides of the metals titanium, molybdenum, tungsten, iron or tin or aluminum oxide, or organic gels, such as agar agar, gelatin or albumin. The novel process is particularly suitable for drying silicic acid gels. It is possible to use gels which contain compounds having a critical temperature of less than 350° C. or mixtures or conglomerates thereof, preferably water and/or liquid organic compounds, as fluid. Suitable fluids include all compounds which are mentioned below in the description of the drying fluids. Particularly suitable fluids are water, $C_1$–$C_6$-alkanols or mixtures thereof, methanol, ethanol, n-propanol and isopropanol being preferred. Isopropanol is most preferred. Depending on the fluid present in the pores, for example, the terms hydrogels and alcogels are used. The novel process is most frequently used for drying silicic acid gels which contain water, the abovementioned liquid organic compounds or mixtures thereof as fluid.

In a preferred embodiment of the invention, the microporous, fluid-containing particles contain from 50 to 97, in particular from 80 to 90, % by weight, based on the total weight of the particles, of fluid under standard conditions (pressure of 1 bar, temperature of 25° C.). The particle diameters are from 1 to 15 mm, particularly from 2 to 6 mm. Macro-, meso- and/or micropores are present in the particles. The microporous particles to be dried may have any shapes, e.g. beads (spheres) or polygonal shapes. The novel drying process is also suitable for drying microporous, fluid-containing particles or structures which may have a certain regular arrangement of the building blocks. Suitable particles are, for example, also structures crystallized in the presence of thermally degradable templates, nanostructures whose regular arrangement is self-organized or nanocomposites or their precursors or clathrates. The microporous particles may also be a specifically doped microporous top layer on a nonporous substrate. Catalysts or compounds which have acquired chemically reactive centers by impregnation or modification or are impregnated or modified during drying are also suitable. Preferably, aerogels are formed after drying. If the particles to be dried contain no fluid suitable for the novel drying, said fluid can be exchanged for a suitable fluid or a more suitable fluid prior to drying. Thus, according to the invention, some microporous particles can be dried using water as fluid. If, however, it is desired to avoid the high critical temperatures and pressures for water as drying fluid, either a water-miscible drying liquid (miscible at least under the drying conditions), for example an alcohol, may be used or the water contained in the hydrogel is exchanged wholly or partly for a fluid more suitable for drying, for example an alcohol. Exchange and drying can also be carried out simultaneously.

The convective heat supply according to the novel process can be effected in various ways and is not subject to any particular restriction. Suitable convection media or streams are all substances which can be brought into the supercritical state without decomposition. Preferably, these are inert to the particles to be dried. In addition, substances may also be added to the convection stream above a certain temperature, in order chemically to modify, to impregnate or, for example, to remove traces of water from the structure to be dried. Modification may be desired if, for example, it enables the interfacial tension to be reduced.

Expediently, drying fluids whose critical data is not too high, in order to avoid more expensive apparatuses, are used as a convection stream or medium during the drying. Suitable drying fluids are ammonia, sulfur dioxide, nitrogen dioxide and sulfur hexafluoride; alkanes, such as propane, butane, pentane, hexane and cyclohexane; alkenes, such as $C_1$–$C_7$-n-, iso-, neo-, secondary or tertiary alkenes, e.g. ethene or propene; alkanols, such as methanol, ethanol, n-propanol, isopropanol or butanols; ethers, such as dimethyl or diethyl ether or tetrahydrofuran; aldehydes, such as formaldehyde or acetaldehyde; ketones, such as acetone; esters, such as the methyl, ethyl, n-propyl or isopropyl esters of formic, acetic or propionic acid; amines, such as mono-, di- and trimethyl- or -ethyl- or n- or isopropylamine or mixed alkylated amines thereof; and mixtures of two or more of these fluids. Among said organic compounds, $C_1$–$C_6$-alkanols, -ethers, -ketones, -aldehydes, -alkanes, -alkenes, -esters or -amines are preferred. $C_1$–$C_3$-Alkanols are most preferred, in particular isopropanol. In principle, halogenated hydrocarbons are also suitable but are avoided for reasons relating to the choice of material and environmental requirements. An attempt is also made to avoid media having high critical temperatures or high pressures, e.g. water. In addition to said drying fluids, supercritical carbon dioxide is also suitable for the drying fluid. This is particularly suitable for thermally sensitive substances, especially because of its advantageous critical temperature of 31° C.

In general, the choice of the drying fluid depends on various points. If it is desired to establish near-critical conditions, inter alia the thermal stability of the particles to be dried or of the end product determines the choice of the drying fluid and thus also limits the critical temperature of the drying fluid. In addition, possible fluid recovery, the toxicological safety, the miscibility with the fluid in the particles to be dried, the product properties and safety data may play a role in the choice of the drying fluid. It is also possible to add to the drying fluid a component which contains functional groups which react or are absorbed or adsorbed onto the surface of the particles to be dried. Thus, uniform covering, coating or impregnation of the particles to be dried can simultaneously be achieved during the drying. A modified application of the drying fluid is, for example, the addition of ammonia to isopropanol as drying fluid, in order, for example, to be able to dry acidic hydrogels without isopropanol decomposing. In the case of methanol as drying fluid, the addition of ammonia prevents the undesired formation of a large amount of ether. For example, when methanol is used as drying fluid, isopropanol or isobutanol can be added for imparting hydrophobic properties to a silicic acid gel. In general, suitable components can be added before or on reaching the critical temperature of the fluid, for chemical or physical modification of the particles to be dried.

It is sufficient if the drying fluid is miscible with the fluid contained in the particles to be dried, at least under the conditions present during the drying. Advantageously, however, the drying fluid used is the same as the fluid contained in the microporous particles. Examples of fluids/drying fluids completely miscible under the drying conditions are mixtures of water with higher alcohols or aromatics.

The convection stream can flow through the bed of the particles to be dried from top to bottom, from bottom to top or outward or in the opposite direction from an axial distributor. Mechanical stability, resilience, particle size distribution and mean diameter of the particles determine the type of flow through the bed. Any finely divided material formed can be entrained in the fluid circulation or separated off. The bed may be wholly or partly fluidized in the event of flow from below. The convection stream can be circulated using a heat-resistant pump or only fresh drying fluid is brought to the required temperature in a straight pass.

In a preferred embodiment of the invention, the drying is carried out in such a way that first the convection medium is fed at atmospheric pressure into the drying space and then the particles to be dried, which are preferably heated, are washed in at atmospheric pressure. The pressure in the drying space is then brought to the desired value close to the critical point. Plug flow is then preferably established with the convection medium. The temperature is then increased until it is close to the critical point. After near-critical or supercritical conditions of the fluid have been reached, the pressure is let down, with the result that the particles are dried. The convection medium can be circulated.

White (Industrial and Engineering Chemistry 31 (1939), No. 7, 827 to 831; Trans. A. I. Chem. E. (1942), 435 to 447) proposes, in a batch process, discharging the liquid in the void volume before the beginning of the drying step. This proposal can be combined with the novel convective heat supply.

The interfacial tension of the liquid contained in the pores of the particles to be dried can also be reduced by adding surface-active substances or by prior modification of the microporous, fluid-containing particles by, for example, silanization, organic esterification or etherification or, in the case of silica gels, by siloxanization of vicinal silane-mono/di/triols of the inner and outer surface.

In a further embodiment, the present invention relates to a process for the preparation of microporous, three-dimensionally networked particles by stages (a) to (e) defined above.

The preparation of microporous particles containing pore liquid can be carried out continuously by processes known to those skilled in the art.

A wash step for the particles obtained in stage (a) can be carried out if undesired components, such as unreacted starting material or impurities in the starting material, are to be removed. For this purpose, the particles from stage (a), in the form of a moving bed, are passed countercurrent to a solvent, preferably a water-miscible one. A salt removal step (b) for the microporous particles containing pore liquid or solvent can be provided before, after or simultaneously with the washing or alone (without washing) if the particles contain undesired salts. If such a step is used, it is carried out continuously by passing the particles obtained in stage (a) or the particles obtained after the washing, in the form of a moving bed, countercurrent to a stream of water. A suitable ratio or a suitable setting for the material streams of particles to be dried and water or solvent for preparing and maintaining the moving bed can be determined by those skilled in the art by means of customary tests. The setting depends, inter alia, on the height of the moving bed, on the internal mass transport in the particles to be dried and on the fluidization point, i.e. on the density and particle size or particle size distribution of the microporous particles to be dried. The water stream or solvent stream is preferably adjusted so that there is no fluidization and hence no undesired separation in the moving bed. Back-mixing on the water side or solvent side is lowest if a water or solvent flow velocity close to the loosening point of the moving bed is employed. All types of pumps which are suitable for conveying particulate material are useful as means of introducing and discharging the particles to be dried, modified concrete pumps having proven particularly useful.

Surprisingly, it has been found that, even in the case of an unstable density stratification on the fluid side, the moving bed process can be used without problems for washing and/or removing salts, i.e. it is possible to use a procedure in which the microporous particles readily migrate from top to bottom without conveying means. To maintain the unstable density stratification, the density difference is spread over a sufficient moving bed length and a minimum relative velocity is established. Furthermore, it was surprising here that an acceptable specific requirement of displacer component is achieved in comparison with a batchwise fixed-bed exchange. Furthermore, it was surprising that, on salt removal in a moving bed by the countercurrent method, very advantageous material requirements (i.e. required fresh water volume for obtaining a specific volume of hydrogel from which salts had been removed) could be achieved. It is all the more surprising since the literature, as stated above, described the salt removal step as very complicated and tedious, for which reason U.S. Pat. No. 3,672,833 proposed the hydrolysis of lower alkyl orthosilicates for preparing silica aerogels.

All desired degrees of wash-out and degrees of salt removal can be established. The washing step and/or salt removal step are accelerated by increasing the temperature, i.e. the higher the temperature the faster they take place. Preferably, they are therefore carried out at elevated temperatures, the upper limit for the temperature being predetermined, inter alia, by the decomposition of the particles to be washed or from which salts are to be removed, their agglomeration/tendency to stick together, dissolution in the fluid, etc. For example, salts can be removed from some silica gels at about 80° C. To improve the cross-mixing, pulsation of the solvent or water stream can also be provided. Furthermore, the moving bed can be loosened by bubbling in gas, e.g. air. Preferably, salts are removed from silica gel in stage (b) after aging.

In stage (c), some or all of the pore liquid contained in the particles, in particular from 97 to 99%, is exchanged for a fluid. Suitable fluids are the fluids described above in the description of the microporous, fluid-containing particles. Analogous to salt removal, elevated temperatures favor the exchange. Regarding the suitable temperature, statements made above under stage (b) are therefore applicable. Furthermore, the statements made above under stage (b) are applicable to the establishment of the moving bed. In the exchange step, too, all desired degrees of exchange can be established. Such an exchange of the pore liquid can of course be dispensed with if the particles obtained in stage (a) or (b) already contain a suitable fluid. It is also possible, in stage (c), for the pore liquid in the particles first to be exchanged for a liquid miscible with the pore liquid but not fluid suitable for drying. In this case, the liquid miscible with the pore liquid is then exchanged for a fluid suitable for drying. In stage (c), it is also possible to feed in material streams of different purities at different heights. Furthermore, a combination of the exchange step with a separation of a fine fraction or, for example, adhering oil from the gelling, is possible and may save a separate classification step. Moreover, the combination of salt removal in stage (b) and exchange in stage (c) in one apparatus may be advantageous under appropriate kinetic conditions. If traces of the original pore liquid present problems in the exchanged particles, they can be removed in a separate moving bed under special conditions, for example by a reaction. This is also possible by adding suitable components at the bottom of the exchange moving bed, and a combination with impregnation of the microporous particles is also possible.

In stage (d), the microporous, fluid-containing particles are dried. The drying is carried out by means of convective heat supply, as described above in the case of the novel drying process.

In any stage (e) carried out, the dried particles are separated or freed from absorptively and/or adsorptively bound gases and/or substances. This step is carried out continuously in the moving bed by the countercurrent method, the dried particles being fed countercurrently to an inert gas stream, preferably under reduced pressure. Suitable inert gases are nitrogen, carbon dioxide or noble gases. Under certain circumstances, air or stack gas may also be used. Regarding the establishment of the moving bed, statements made above under stage (b) apply analogously. It is also possible to add to the inert gas phase a component which reacts with the dried particles or is absorbed or adsorbed. The separation step can, if required, be improved by adsorption by displacement with a more strongly adsorbing substance. In some cases, the removal of the absorptively and/or adsorptively bound substances and/or gases can be effected simply by applying reduced pressure.

Stage (e) can be followed by a continuous final treatment step in which the microporous, three-dimensionally networked particles are brought into the desired form, for example by milling, sieving or mixing with additives suitable for use. It is also possible to provide the particles obtained with a hard coat, for example by means of sintering, in order to increase their mechanical strength.

The microporous, three-dimensionally networked particles obtained are the same particles as have been described above in the case of the novel drying process, these particles additionally having been freed from undesirable secondary substances compared with the abovementioned particles.

The microporous particles obtainable by means of the novel process can be used in many industrial areas. They are suitable, inter alia, for the preparation of transparent or opaque thermal insulation materials (under certain circumstances as a substitute for chlorofluorocarbon-containing materials). They are also used as catalysts and catalyst supports, adsorbents, electrodes (carbon aerogels obtained by coking of microporous polymers, for example in capacitive energy stores when impregnated with electrolyte), membranes, Cerenkov detectors, superlight sponges for inclusion/storage or gelling agents/thickeners/thixotropic agents for liquid fuels for space flight, insecticides, sinterable intermediates for ceramics or high-purity optical fibers, piezoceramic oscillators in ultrasonic transmitters, in acoustic antireflective layers, as dielectrics, as carriers for fluorescent dyes, as dulling agents, as additives in lubricants, rubber and sealants, in composite materials and in coatings and lakes.

The novel apparatus for drying microporous, fluid-containing particles comprises at least one two-shell container comprising inner container and pressure-withstanding outer container and suitable measuring and control apparatuses and pump apparatuses and heat exchangers. According to the invention, the inner container is provided or intended for holding the particles to be dried, and a gap or space is provided between the inner container and outer container. The inner container may have any desired shape but is preferably rotationally symmetrical, for example a cylinder having a conical outflow or a sphere, so that, in a preferred embodiment, the gap is formed rotationally symmetrically. The inner container may be formed to be conical at the top and/or the bottom. It may be produced from any material which still has the required strength at the drying temperature to be established. Stainless steel, boiler plate or glass fiber-reinforced plastics are preferred. Stainless steel is most preferred. The inner container is preferably thin-walled and is preferably designed for pressures of less than 6 bar. The outer container consists of materials which have the pressure resistance required for drying. Grain-refined structural steel or creep-resistant steel is preferred. The gap or space between the inner container and outer container ensures thermal insulation. It is expediently filled with an inert gas, preferably a poorly heat-conducting gas, such as nitrogen or krypton. To improve the insulation, it can also be filled with insulation material (e.g. rockwool or glass wool).

The Figure describes an apparatus comprising inner container and outer container and suitable measuring and control apparatuses and pumps and heat exchangers, which apparatus is particularly suitable for carrying out the novel drying process. The actual dryer consists of the thin-walled inner container 1 and the pressure-withstanding outer container 2. The novel process is carried out as follows. First, the inner container 1 is filled with drying fluid via line 3. The particles to be dried are then washed in from the storage container 4 via line 5 at the top of the dryer by means of drying fluid. The dryer is closed and the pressure therein is increased to near-critical to supercritical conditions. The pump 6 then forces the drying fluid heated in heat exchanger 7 into the particle bed from below. The drying fluid is fed from the top of the dryer back to the pump 6 or partly released via valve 8 to keep the pressure in the dryer constant, until near-critical to supercritical temperatures have been established throughout the dryer. Valve 8 is then opened. The dried particles are removed via line 9. Differential pressure control is preferably used between inner container 1 and outer container 2, since the inner container 1 should as far as possible be constructed with thin walls. This differential pressure control operates as follows: if the level in storage vessel 10 rises because excess pressure is present in the drying fluid circulation and drying fluid flows via the cooler 11 to the storage vessel 10, the pressure of the $N_2$ cushion in the gap formed between the inner and outer container is increased via a level sensor 12 with the aid of an $N_2$ split range control 13. If the level in the storage container 10 drops, the $N_2$ split range control 13 correspondingly reduces the pressure of the $N_2$ cushion in the gap. To avoid introduction of a fine fraction into the storage container 10, a small cleaning fluid stream 14 is passed to the storage container 10 via a flow control. This material stream may also perform, inter alia, the task of reducing the build-up of troublesome components which form, by feeding fresh fluid. If the control of the differential pressure between inner container 1 and outer container 2 fails, an overflow valve between inner container and outer container (not shown) preferably protects the inner container 1. To protect the inner container 1, the pressure drop between the bottom and top of the particle bed should be limited. If corresponding controls fail, the inner container 1 is protected from destruction by a further overflow valve in a dryer bypass (not shown).

The invention has the advantages that considerable quantities of energy are saved since the outer container is subject to only a small temperature change in the course of drying. In addition, the thermal cycling of the flanges and other parts of the apparatus is substantially reduced in comparison with known processes from the prior art. In order to load the dryer, only the inner container has to be cooled, for example by evaporative cooling. By dispensing with heat-up and cooling processes of the outer container, the batch time is considerably reduced.

Surprisingly, it has been found that, with flow through a bed from bottom to top, as shown in the Figure, a major part of the initially taken liquid can be displaced from the container at room temperature. In comparison with a continuous powder process in which large amounts of solvent have to be heated cocurrently with the solid to be dried, further energy is thus saved. Surprisingly, it has furthermore been found that conventional silicic acid alcogel granules obtained from hydrogel are not destroyed or damaged by the convective heat supply, either mechanically or as a result of thermal stresses. This also applies to gel beads in the lowermost layer of the bed, which are still at ambient temperature and into which fluid at 300° C. flows.

The invention is additionally illustrated in more detail by the following Example, which is a preferred embodiment of the invention.

EXAMPLE

Stage (a): Hydrogel Preparation

Silicic acid hydrogels were prepared according to DE-A-21 03 243, DE-A-44 05 202 and DE-A-16 67 568. At least 95% by volume thereof had a bead diameter of from 2 to 12 mm. Coarse materials were separated off by means of a wire rod sieve immersed in water. Next, the silicic acid hydrogels were subjected to continuous hydraulic classification prior to salt removal.

Stage (b): Salt Removal

Apparatus

Two desalination moving beds, each 11 m high and 800 mm wide, were equipped with sampling points at various heights. Fresh water was fed in at the bottom by distributors and salt water was removed at the top via slit sieve cartridges. The cellular wheel sluice at the bottom adjusted the solids streams. At low flow velocities and in the case of gels tending to stick, the cross-mixing in the bed was improved by means of static mixers.

Procedure

In each desalination moving bed, a stream of about 2450 l/h of water was fed from below countercurrent to a downward-moving stream of about 510 l/h of classified hydrogel from the preceding stage (about 150 of the 510 thereof are accounted for by the gap volume). After about 30 hours at the latest, a steady state had been established in the moving bed. The conductivity of the samples which were removed at the various points along the bed no longer showed any changes. A conductivity of more than 1 milli-Siemens/cm was measured in the overflow. The water in the gap volume of the hydrogel from which salt had been removed had a conductivity of 40 micro-Siemens/cm, which corresponds to a sodium content of about 1% by weight in the gel.

Stage (c): Water/Alcohol Exchange

Apparatus

The liquid exchange step was carried out in a moving bed which was 11 m high and 500 mm wide and which was designed similarly to that used for the salt removal. The alcohol was fed in above the cellular wheel sluice, by means of a distributor. The water/alcohol mixture was able to flow away via slit sieves. At low flow velocities and in the case of gels which tended to stick, the cross-mixing in the bed was improved by means of static mixers.

Procedure

About 1400 /h of isopropanol were fed countercurrent to about 1000 /h of the hydrogel from stage (b), from which salt had been removed. After 10 hours at the latest, a steady state had been established in the moving bed. The densities of the samples from the various sampling points along the bed no longer showed any change. The residual water content of the gel which was discharged at the bottom of the moving bed was less than 1% by weight. The specific isopropanol demand volume ratio was thus 1.4:1.

Stage (d): Drying

Apparatus

The apparatus used corresponded schematically to the apparatus shown in the Figure. Thus, the apparatus used consisted of a 100 bar pressure-resistant outer container of creep-resistant steel, plated with stainless steel on the inside, and a 400 mm wide inner container of stainless steel. The outer container was 8 m high and cylindrical and had an external diameter of 600 mm and a wall thickness of 50 mm. The inner container had a wall thickness of 4 mm and tapered conically at the top and bottom. The effective volume was 1 $m^3$. The nitrogen-filled annular gap between the inner container and outer container was 50 mm wide in the cylindrical region. The inner container communicated with the drying fluid circulation, in which pressure control means, circulation pump and heat exchanger were housed. A nozzle, which had the alcogel feed line centrally and the sieve surface for fluid/solid separation on its outer cylindrical side, projected into the top of the inner container.

Procedure

The pressure-withstanding part of the dryer was heated to 300° C. with 100 bar steam. The inner container was evaporatively cooled by isopropanol addition. Alcogel was washed in with isopropanol, which was circulated. During this loading process, the temperature of the alcogel scarcely increased. After the dryer had been closed, the annular gap and inner container were brought to 60 bar. Regarding details of the pressure control, reference may be made to the Figure. The pump was switched on and drying fluid was fed in, initially at low speed, e.g. 1 $m^3$ per hour, at a density above 0.7 kg/l. Flow through the alcogel bed was from below. The heat exchanger was then heated. The pump speed could be increased with decreasing density of the drying fluid. Instead of the density, the temperature at the top of the dryer could also be used as a reference variable. 70% of the isopropanol were displaced from the circulation at room temperature.

After 50 minutes, the supercritical temperature was reached at the top of the bed. The pressure was let down without affecting the two-phase region.

Stage (e): Removal of Sorbed Gases/Substances

Apparatus

A 3 $m^3$ silo was used for removal/separation of the sorbed gases/substances.

Procedure

After the pressure had been let down, the aerogel was transferred pneumatically into the silo. The silo was then evacuated and a gentle stream of nitrogen was allowed to flow through the bed at about 30 mbar. This nitrogen stream exchanged the gas atmosphere in the silo ten times per hour. Consequently, the partial pressure of desorbed alcohol was kept low and the desorption was accelerated and completed. The residence time was more than 30 minutes, in order also to remove sorbed gases/substances from the Knudsen pores of the aerogel. If it was desired or necessary to cool, the silo was operated at atmospheric pressure and $N_2$ was circulated via a scrubber.

Treatment

The continuous treatment step was carried out by milling and mixing in dopants (blowing in) in a pinned disk mill.

The aerogel granules obtained had a particle size of up to 12 mm, only 2% by volume of the granules having a particle size of less than 2 mm. The mean thermal conductivity $e_{10}$ of the 2–3 mm fraction of the granules was better than 18 mW/(m·K) according to DIN 52616, and was 16 mW/(m·K) for the powder. The transparency of the 2–3 mm fraction was 60% for a layer thickness of 1 cm. The bed density according to ISO 3944 was from 70 to 130 g/l. The aerogel was water-repellent and floated on water. The headspace (the gas phase above the bed) of the aerogel was nonexplosive at 100° C. and explosive at 160° C. only after one hour.

Surprisingly, it was found that the gel was not damaged in spite of the rapid heating up, that the abrasion resistance of the gel was sufficient and that scarcely any water accumulation in the fluid occurred. In some cases, even a reduction in the water content was observed, which permitted reuse of the solvent without thermal working-up, without accumulation of water in the drying fluid occurring.

We claim:

1. A process for drying microporous, fluid-containing particles by reducing the interfacial tension of the fluid at room temperature, by increasing the temperature that exist from close to the critical pressure to supercritical pressure of the fluid, which comprises supplying the heat required for the temperature increase by convection.

2. A process as claimed in claim 1, wherein the fluid-containing particles dried are gels which contain water, $C_1$–$C_6$-alkanols or mixtures thereof as fluid.

3. A process as claimed in claim 1, wherein gels which contain isopropanol as fluid are dried.

4. A process as claimed in claim 1, wherein silicic acid gels are dried.

5. A process as claimed in claim 1, wherein a drying fluid is used for the convective heat supply.

6. A process as claimed in claim 5, wherein the drying fluids used are $C_1$–$C_6$-alkanols, $C_1$–$C_6$-ethers, $C_1$–$C_6$-ketones, $C_1$–$C_6$-aldehydes, $C_1$–$C_6$-alkanes, $C_1$-$C_6$alkenes, $C_1$–$C_6$-esters or $C_1$–$C_6$-amines or carbon dioxide.

7. A process as claimed in claim 5, wherein the drying fluid used is the same fluid as that contained in the microporous particles.

8. A process for the preparation of microporous, three-dimensionally networked particles by (a) preparing microporous particles containing pore liquid or fluid, (b) optionally washing and/or removing salt from the particles obtained in stage (a) and containing pore liquid, by means of a solvent and/or water, (c) optionally partially or completely exchanging the pore liquid or the solvent or the water in the particles for a fluid to obtain microporous, fluid-containing particles, (d) drying the microporous, fluid-containing particles and (e) optionally separating off sorbed gases and/or substances from the dried particles from stage (d), wherein the drying in stage (d) is carried out as defined in claim 1 and stages (b), (c) and (e) are carried out in a moving bed by the countercurrent method, by passing, in stage (b), the particles obtained in stage (a) countercurrent to a solvent stream and/or water stream, passing the particles countercurrent to the fluid in stage (c) and passing the dried particles countercurrent to an inert gas stream in stage (e).

9. An apparatus for carrying out the drying process as claimed in claim 1 which comprises a pressure container having an inner container and a pressure-withstanding outer container and measuring and control apparatuses and pump apparatuses and heat exchangers, the inner container being provided for holding the particles to be dried and a gap being provided between the inner container and the outer container.

10. An apparatus as claimed in claim 9, wherein the inner container comprises stainless steel and the pressure-withstanding outer container comprises creep-resistant steel.

11. The process as claimed in claim 1, wherein the interfacial tension of the fluid is reduced to 0 to 1/10 of the interfacial tension of the fluid at room temperature.

12. The process as claimed in claim 1, wherein the interfacial tension of the fluid is reduced to 0 to 1/20 of the interfacial tension of the fluid at room temperature.

* * * * *